US006471542B1

(12) United States Patent
Comer

(10) Patent No.: US 6,471,542 B1
(45) Date of Patent: Oct. 29, 2002

(54) POWER ADAPTER CARRYING STRAP

(75) Inventor: Keith Comer, Mission Viejo, CA (US)

(73) Assignee: Toshiba America Information Systems, Inc., Irvine, CA (US)

( * ) Notice: Subject to any disclaimer, the term of this patent is extended or adjusted under 35 U.S.C. 154(b) by 96 days.

(21) Appl. No.: 09/717,922

(22) Filed: Nov. 21, 2000

(51) Int. Cl.[7] ..... H01R 13/72
(52) U.S. Cl. ..... 439/501; 439/531
(58) Field of Search ..... 439/501, 4, 527, 439/531, 502

(56) References Cited

U.S. PATENT DOCUMENTS 2,039,916 A * 5/1936 McIntosh ..... 439/502
2,509,809 A * 5/1950 Cook ..... 439/502
5,720,628 A * 2/1998 Usui et al. ..... 439/501
6,210,211 B1 * 4/2001 Landrum et al. ..... 439/501
6,325,665 B1 * 12/2001 Chung ..... 439/501

* cited by examiner

*Primary Examiner*—Gary F. Paumen
*Assistant Examiner*—Felix O. Figueroa
(74) *Attorney, Agent, or Firm*—Pillsbury Winthrop LLP

(57) ABSTRACT

A power adapter carrying strap for a portable electronic device includes a carrying strap and a power adapter coupled to the carrying strap to receive power from an outlet and to provide power useable by the portable electronic device. A power plug is connected to the power adapter via a cable so that the power plug is adapted to plug into the outlet to receive power. A power supply plug is connected to the power adapter, wherein the power supply plug is adapted to plug into the portable electronic device to provide power to the portable electronic device.

19 Claims, 3 Drawing Sheets

POWER ADAPTER CARRYING STRAP

BACKGROUND OF THE INVENTION

1. Field of the Invention

The present invention relates to power supplies for portable devices, and more specifically, to a power adapter for use with a portable electronic device.

2. Discussion of the Related Art

Portable electronic devices, such as notebook computers, have become so popular that many people utilize them as their primary computer, forgoing the desktop computer system. Although battery technology continues to make significant progress, typically, users of notebook computers will still plug in their notebook computers when a power outlet is available, thereby "saving" the battery power, not to mention charging the battery in the notebook computer so that the notebook computer may be utilized when a power outlet is unavailable.

Many notebook computer users carry their notebook computers in a carrying case, adapted to securely carry and store the notebook computer, along with computer accessories. These computer accessories may include the power adapter plug, external disk drives, CD-ROM drives, DVD drives, storage media (floppy diskettes, CD-ROMs, DVDs, etc.), and PCMCIA cards (for Ethernet connection cables, modems, memory, data storage, etc.). These notebook computer carrying cases typically have a carrying strap, which allows the user to easily carry the carrying case containing the notebook computer over the shoulder using the strap, much like that of a purse. Additionally, some notebook computers are adapted so that, instead of using a carrying case, a carrying strap may be secured onto the notebook computer itself, and the notebook computer itself may be carried over the shoulder using the carrying strap.

When the notebook computer user is at a location where a power outlet is available, the user typically takes out the power adapter plug, usually stored in the carrying case, and plugs the power adapter plug into the power outlet at one end, and into the notebook computer at the other end. The wires or cables of the power adapter plug are usually "rolled up" when not in use, and "unrolled" when taken out of storage to plug into the power outlet and the notebook computer. The rolling and unrolling of the power adapter plug is generally repeated each time the user moves from one location to another to utilize the power outlets available at each location. Additionally, these power adapter plugs must be carried along with the notebook computer, either within the carrying case itself, or any other location, including on the person of the user.

DETAILED DESCRIPTION

Figure 1:
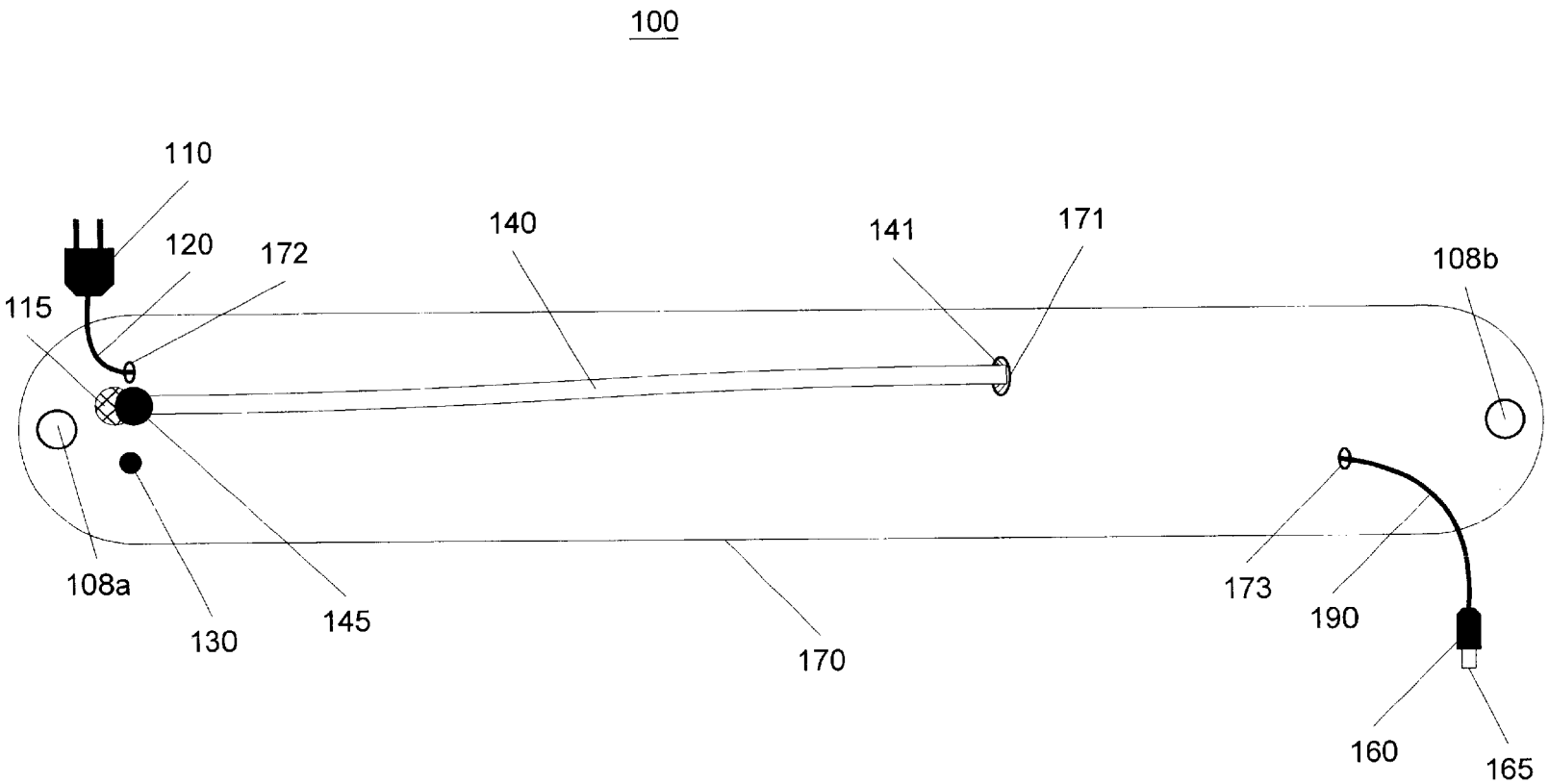
FIG. 1 illustrates a power adapter carrying strap according to an embodiment of the present invention.

FIG. 1 illustrates a power adapter carrying strap according to an embodiment of the present invention. The power adapter carrying strap 100 may have an carrying strap 170 constructed of any suitable material for use as a carrying strap, including plastic, cloth, and leather. The material of the carrying strap 170 may be woven, molded, glued, bonded, or otherwise joined so as to encase some or all of the remaining components of the power adapter carrying strap 100, as shown in the embodiment in FIG. 1. The power adapter carrying strap 100 itself resembles a typical carrying strap, and may include holes, fasteners, hooks, or any other attachment device 108*a*, 108*b* that allows the power adapter carrying strap 100 to be secured to a carrying case, or to a portable electronic device, such as a notebook computer. The portable electronic device may also be a stereo, CD player, cassette player, DVD player, television, camcorder, etc. The size and shape of the carrying strap 170 may be of any design that is suitable for use as a carrying strap for supporting a carrying case or a portable electronic device.

In alternative embodiments of the invention, components of the power adapter carrying strap 100 may be attached to the exterior of the carrying strap 170. For example, a power adapter 150 may be coupled to the carrying strap 170 to receive power from an outlet and to provide power useable by the portable electronic device. The power adapter 150 may be encased within the material of the carrying strap 170, or coupled to one side of the carrying strap 170, preferably in a manner so that it is not unsightly from view, and positioned in a location along the carrying strap 170 so as to not interfere with the use of the power adapter carrying strap 100, such as slinging it over the shoulder of the user.

The power adapter 150 may be any suitable power adapter device that is capable of providing power to an electronic device in a form (e.g., voltage, current) useable by that electronic device. Because many portable electronic devices (particularly including portable electronic devices, such as notebook computers) utilize direct current (DC) power, power drawn from a power outlet, which is an alternating current (AC) power source, may be converted into DC power by the power adapter 150 so that the power is useable by the electronic device. Different power adapter types may be utilized depending on the particular electronic device utilized, because of the different power constraints each electronic device may have. Additionally, "sustaining" power adapters or "charging" power adapters may be utilized as well. A sustaining power adapter may provide enough power to keep the electronic device operating, but not enough power to charge the battery of the portable electronic device. A charging power adapter is capable of providing power to keep the electronic device operating, in addition to charging the battery of the electronic device. Charging power adapters are generally larger than sustaining power adapters, and therefore, depending on the actual size and shape of the carrying strap 170, one type of power adapter 150 may be utilized over the other within the power adapter carrying strap 100.

In an embodiment of the invention, a power plug 110 may be connected to the power adapter 150 via a cable 120, of suitable gauge and insulation. The power plug 110 may be adapted for plugging into a power outlet or socket, such as a wall-mounted socket or outlet, to draw power from the outlet. The cable 120 carries the electricity from the power outlet to the power adapter 150.

According to an embodiment of the present invention, the cable 120 and power plug 110 may be extendable and retractable from the carrying strap 170. That is, in the retracted state, substantially all of the cable 120 is contained within the carrying strap 170, with the power plug 110 itself protruding from the carrying strap 170 through the power plug aperture 172. A compartment within the carrying strap 170 may take up the excess portion of the cable 120 in the retracted state. In the extended state, this excess portion of the cable 120 would protrude from the carrying strap 170 along with the plug 110. A guide 130 within the power adapter carrying strap 100 may also be utilized to facilitate the extension and retraction of the cable 120 and the power plug 110.

Figure 2:
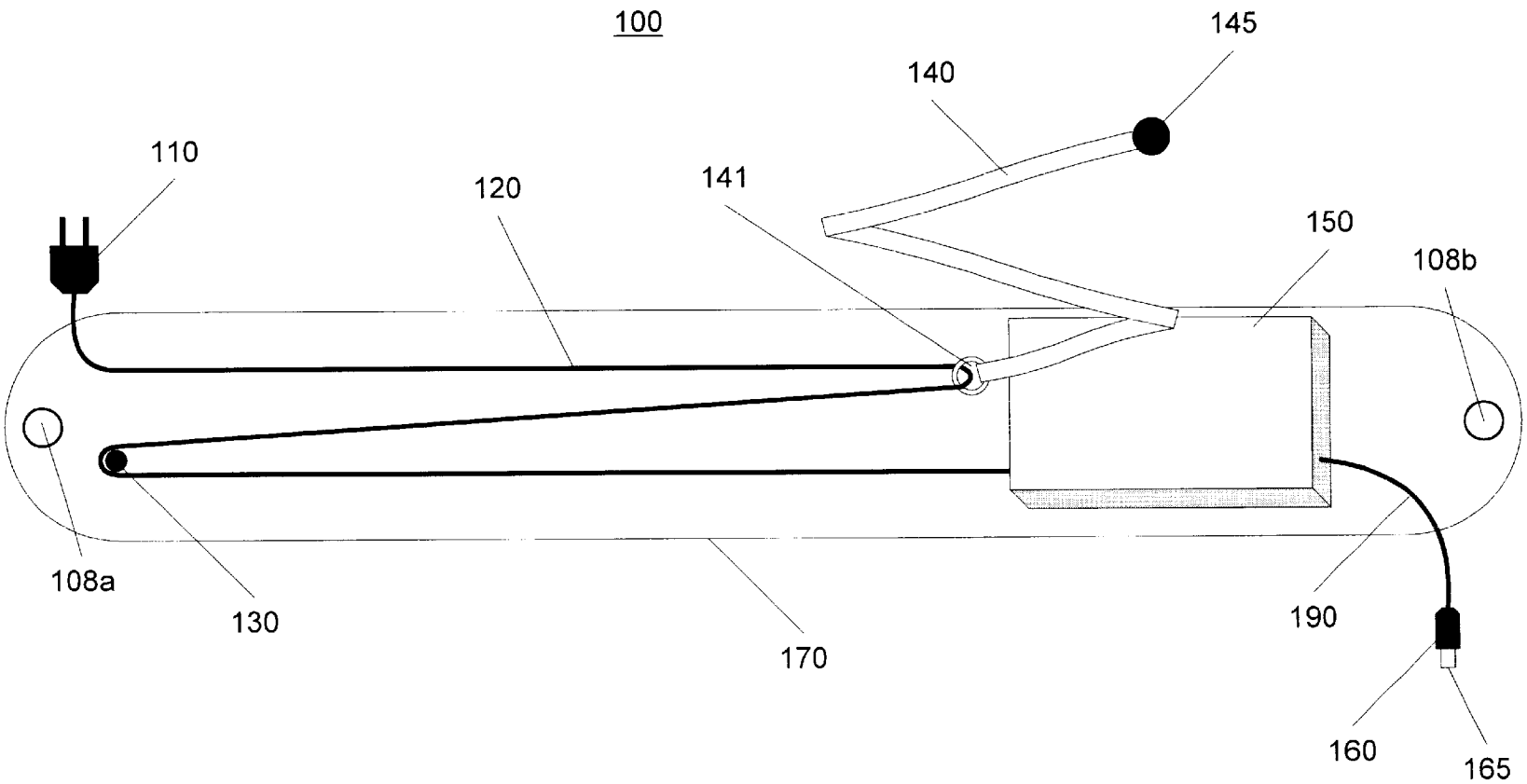
FIG. 2 illustrates the power adapter carrying strap according to the embodiment of the present invention shown in FIG. 1 with the top layer of the carrying strap removed and the power plug and cable in the retracted state.
Figure 3:
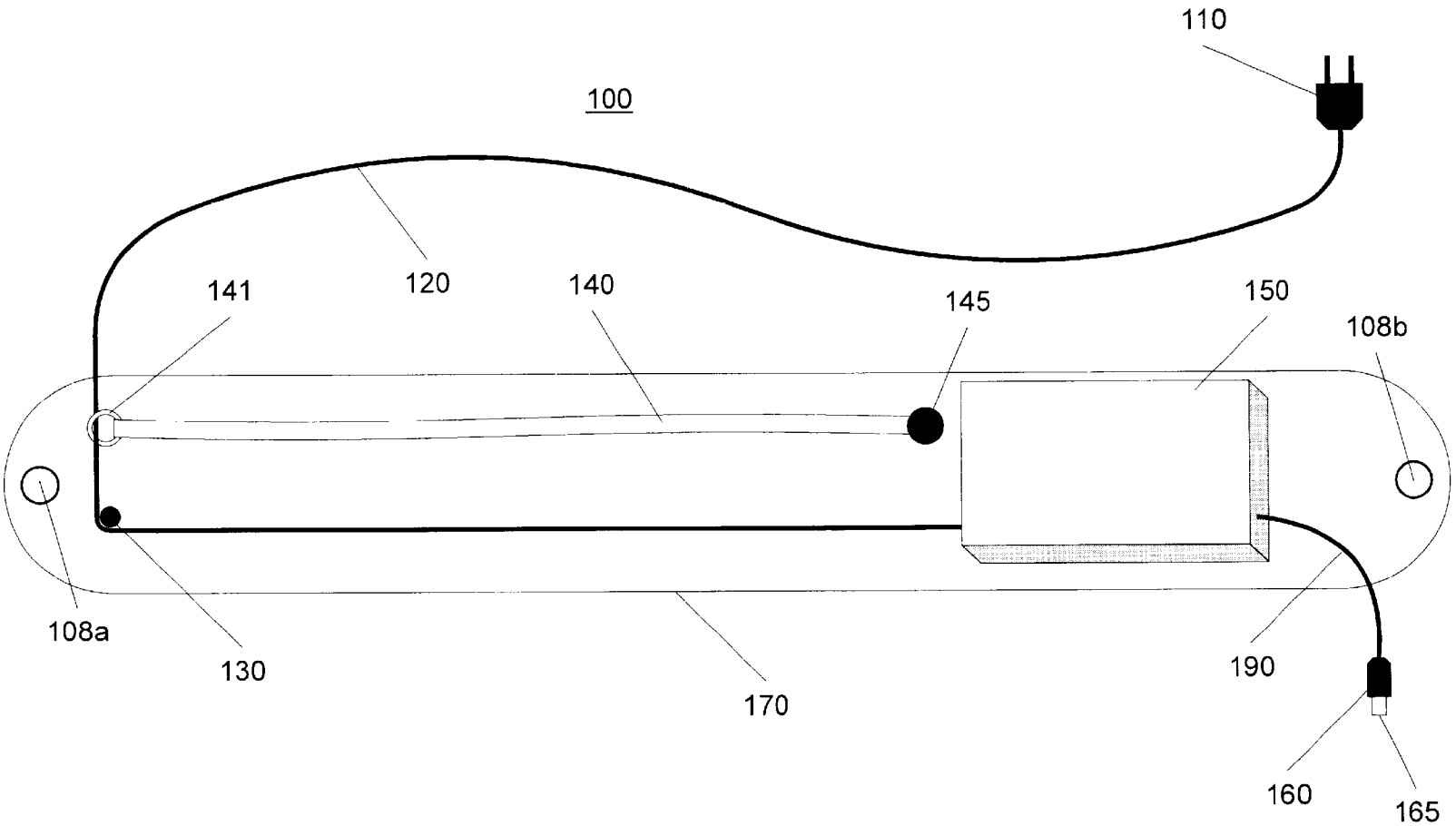
FIG. 3 illustrates the power adapter carrying strap according to the embodiment of the present invention shown in FIG. 1 with the top layer of the carrying strap removed and the power plug and cable in the extended state.

FIG. 2 shows an embodiment of the power adapter carrying strap 100 with the cable 120 and power plug 110 in the retracted state and with the top layer of the carrying strap 170 removed. FIG. 3 shows an embodiment of the power adapter carrying strap 100 with the cable 120 in the extended state and with the top layer of the carrying strap 170 removed. The power plug 110 along with the cable 120 may be extended (by pulling the power plug 110) so that more of the cable protrudes from the carrying strap 170 through the power plug aperture 172 and plugged into the power outlet. The power plug aperture 172 may be sized so that the power plug 110 may not pass through the power plug aperture 172 into the carrying strap 170.

In the pictured embodiment, the cable 120 in its retracted state may be wound around the guide 130 and configured in an "S" shape within the carrying strap 170 by pulling on ribbon 140 until the ring 141 attached at one end of the ribbon 140 is in contact with the ribbon aperture 171.

The cable 120 may run through a hole in the ring 141 such that when the ring 141 is moved by pulling on the ribbon 140, the cable 120 is also moved. To hold the cable 120 in its retracted position, the ribbon 140 may be attached to a ribbon fixture 115. The ribbon fixture 115 may be a Velcro piece, a snap, a buckle or a similar attachment device.

The ribbon 140 may also have a bead 145 affixed to the end opposite the ring 141. When the cable 120 is in the extended state, substantially all of the ribbon 140 may be drawn into the carrying strap 170 through the ribbon aperture 171. The bead 145 may be suitably sized so that the bead 145 may not pass through the ribbon aperture 171. In this way, the user may later pull on the bead to bring the ribbon 140 out of the carrying strap 170 to bring the cable 120 into the retracted state again. The ribbon aperture 171, power plug aperture 172 and/or device aperture 173 may include a grommet or collar to retain a desired shape and/or size.

When a power source is distant from the electronic device, it may be desirable to extend the cable 120 so that the power plug 110 may be connected to the power source. Moreover, even if the power outlet is within the length of the power adapter carrying strap 100, utilizing a retracting and extending feature of the power plug 110 and cable 120 is more convenient to the user so that there is no need to detach the strap 100 at one end in order to plug the power plug 110 into the power outlet. When the cable 120 is in its extended state, the cable 120 may extend from the power adapter 150 to the guide 130 and then to the power plug aperture 172. The "excess" portion of the cable 120, which may be stored in the carrying strap 170 when the cable 120 is in its retracted state, may protrude from the power plug aperture 172 so that the power plug 110 may be connected to a distant power source.

In other embodiments of the invention, other suitable mechanisms for retracting and extending the cable 120 from the power adapter carrying strap 100 may be utilized. In alternative embodiments of the invention, excess portions of cable 120 that do not protrude from the carrying strap 170 in the retracted state may be taken up on a spool or winding. In such embodiments, the spool or pulley may be bias-loaded using a spring so that the excess portions of cable 120 are taken up by the spool or winding unless the ribbon 140 is attached to the ribbon fixture 115. In embodiments of the invention, the ring 141 may be replaced with a pulley which may be moved within the compartment of the carrying strap 170 containing the excess portions of cable 120. The cable 120 may placed in the groove of the pulley so that a portion of the cable 120 extends on both sides of the pulley. As the pulley is moved away from the power adapter 150 within the carrying strap 170, more of the cable 120 may be drawn into the carrying strap 170.

Also, in alternative embodiments of the invention, the ribbon 140 may be replaced with some other mechanism that is coupled to the power adapter carrying strap 100 so as to retract the cable 120, along with the power plug 110, when activated. That is, a ribbon, lever, button, or any other actuator may be utilized in order to retract the cable 120 into the power adapter carrying strap 100.

A device interface plug 160, having a pin-out 165 adapted to connect to a power input jack of a portable electronic device such as a notebook computer, is also connected to the power adapter 150 via a device interface cable 190. If a carrying case is utilized, the device interface plug 160 may plug into the power input jack of the portable electronic device through an opening in the carrying case, and the notebook computer may be utilized while still within the carrying case, with the carrying case opened. According to one embodiment, the device interface plug 160 may be at the opposite end of the power adapter carrying strap 100 from the power plug 110, but, the device interface plug 160 may be located at any convenient location that allows connection with the power input jack of the portable electronic device. The device interface plug 160 may provide DC power to the portable electronic device from the power adapter 150 after the power adapter 150 converts the AC power received from the power outlet via the power plug 110 and cable 120. In embodiments of the invention, the device interface plug 160 and device cable 190 may also be extendable and retractable in a fashion similar to that of the power plug 110 and cable 120. In such embodiments, the device interface plug 160 and device cable 190 may protrude from the carrying strap 170 through the device aperture 173.

The portable electronic device may include an alarm feature. The alarm feature provides that if the power from the power outlet is disconnected (i.e., the power plug 110 is disconnected from the power outlet, or the device interface plug 160 is disconnected from the portable electronic device), the portable electronic device will sense the power cut-off, and signal or sound an alarm. This alarm feature allows the user to leave the portable electronic device plugged into the power outlet and to, for example, run a quick errand or go to the bathroom. Therefore, the alarm will sound if someone tries steal or move the portable electronic device and unplug the portable electronic device from the power outlet or from the device interface plug 160. The portable electronic device, or the screen of a notebook computer, may display a warning indicating that an alarm will sound if the device is unplugged. Of course, the alarm feature may be configured to be turned on or off at any time.

While the description above refers to particular embodiments of the present invention, it will be understood that many modifications may be made without departing from the spirit thereof. The accompanying claims are intended to cover such modifications as would fall within the true scope and spirit of the present invention. The presently disclosed embodiments are therefore to be considered in all respects as illustrative and not restrictive, the scope of the invention being indicated by the appended claims, rather than the foregoing description, and all changes that come within the meaning and range of equivalency of the claims are therefore intended to be embraced therein.

What is claimed is:

1. A power adapter carrying strap for a portable electronic device, comprising:

a carrying strap;

a power adapter coupled to the carrying strap to receive power from a power source and to provide power useable by the portable electronic device;

a power plug connected to the power adapter via a cable, wherein the power plug is adapted to connect to the power source to receive power; and a device interface plug connected to the power adapter via a device cable, wherein the device interface plug is adapted to connect to the portable electronic device to provide power to the portable electronic device.

2. The power adapter carrying strap according to claim 1, wherein at least one of said cable and said device cable is extendable from and retractable within the carrying strap.

3. The power adapter carrying strap according to claim 1, wherein the power plug is an alternating current (AC) plug to receive AC power from an outlet.

4. The power adapter carrying strap according to claim 1, wherein the device interface plug is a direct current (DC) plug adapted to connect to and provide DC power to the portable electronic device.

5. The power adapter carrying strap according to claim 1, wherein the carrying strap is secured onto a carrying case that carries the portable electronic device.

6. The power adapter carrying strap according to claim 1, wherein the carrying strap is secured onto the portable electronic device.

7. The power adapter carrying strap according to claim 1, wherein the power adapter receives alternating current (AC) power from the power source, converts the AC power into direct current (DC) power, and provides the DC power to the portable electronic device.

8. The power adapter carrying strap according to claim 1, wherein the portable electronic device is a computer.

9. The power adapter carrying strap according to claim 1, wherein the power adapter provides a sustaining power supply to the portable electronic device.

10. The power adapter carrying strap according to claim 1, wherein the device interface plug is connected to the power adapter by a device interface cable and the device interface cable is extendable from and retractable within the carrying strap.

11. The power adapter carrying strap according to claim 1, wherein the power adapter provides a charging power supply to the portable electronic device.

12. The power adapter carrying strap according to claim 2, further including a ribbon to retract the cable within the power adapter carrying strap when the ribbon is pulled.

13. A power adapter carrying strap for a portable electronic device, comprising:

a carrying strap;

a power adapter coupled to the carrying strap to receive power from an outlet and to provide power useable by the portable electronic device;

a power plug connected to the power adapter via a cable, wherein the power plug is adapted to connect to the outlet to receive power, and the cable connecting the power plug to the power adapter is extendable and retractable within the power adapter carrying strap;

a device interface plug connected to the power adapter, wherein the power supply plug is adapted to connect to the portable electronic device to provide power to the portable electronic device; and a ribbon connected to said cable, such that said cable is retracted within said power adapter carrying strap when said ribbon is pulled.

14. The power adapter carrying strap according to claim 13, wherein the device interface plug is connected to the power adapter by a device interface cable and the device interface cable is extendable from and retractable within the carrying strap.

15. The power adapter carrying strap according to claim 13, wherein said ribbon is slideably connected to said cable via a ring, said ring connected to said ribbon and having a central hole through which said cable passes.

16. The power adapter carrying strap according to claim 13, wherein said ribbon protrudes from said carrying strap through a ribbon aperture, and further wherein said ribbon includes a bead having at least one of a size and a shape sufficient to prevent said bead from passing through said ribbon aperture.

17. A power adapter carrying strap for a portable electronic device, comprising:

a carrying strap;

a power adapter coupled to the carrying strap to receive power from an outlet and to provide power useable by the portable electronic device; and a cable having a first end connected to said power adapter, said cable being extendable and retractable within said carrying strap.

18. The power adapter carrying strap according to claim 17, wherein said cable is retracted within said carrying strap by pulling on a ribbon slideably connected to said cable, said ribbon protruding from said carrying strap through a ribbon aperture, and said ribbon further including a bead having at least one of a size and a shape sufficient to prevent said bead from passing through said ribbon aperture.

19. An apparatus for carrying a portable electronic device, said portable electronic device receiving power from a power adapter, said apparatus comprising:

a carrying strap;

a power plug connected to the power adapter via a cable, wherein the power plug is adapted to connect to a power source to receive power; and a device interface plug connected to the power adapter via a device cable, wherein the device interface plug is adapted to connect to the portable electronic device to provide power to the portable electronic device, wherein at least one of said cable and said device cable is extendable from and retractable within said carrying strap.

* * * * *